United States Patent [19]

Cunning

[11] 4,314,683

[45] Feb. 9, 1982

[54] GUTTER HANGER

[75] Inventor: Joseph M. Cunning, Cohasett, Mass.

[73] Assignee: Bird & Son, Inc., East Walpole, Mass.

[21] Appl. No.: 137,563

[22] Filed: Apr. 7, 1980

[51] Int. Cl.[3] ..... E04D 13/06

[52] U.S. Cl. ..... 248/48.2

[58] Field of Search ..... 248/48.2; 52/11, 16

[56] References Cited

U.S. PATENT DOCUMENTS

| | | | |
|---|---|---|---|
| 1,855,241 | 4/1932 | Irwin | 248/48.2 |
| 2,928,634 | 3/1960 | Bender | 248/48.2 |
| 3,022,029 | 2/1962 | Blayden | 248/48.2 |
| 3,150,851 | 9/1964 | Ritchie et al. | 248/48.2 |
| 3,340,653 | 9/1967 | Steeg | 52/11 |

FOREIGN PATENT DOCUMENTS

| | | | |
|---|---|---|---|
| 225177 | 10/1957 | Australia | 52/11 |
| 272934 | 2/1967 | Australia | 52/11 |
| 296054 | 4/1967 | Australia | 52/11 |
| 496136 | 5/1977 | Australia | 52/11 |
| 2378917 | 9/1978 | France | 52/11 |

*Primary Examiner*—William H. Schultz

[57] ABSTRACT

A gutter hanger for attaching a horizontal, generally U-shaped gutter to the wood fascia of a building features a rigid, one piece, generally L-shaped bracket having integrally connected, mutually perpendicular, upper forwardly extending and rear downwardly extending legs.

3 Claims, 3 Drawing Figures

GUTTER HANGER

This invention relates to gutter hangers adapted for attaching metal or plastic house gutters to the fascia of a building.

In recent years, extruded gutters have found increasing acceptance as a substitute for conventional wooden gutters in house construction, since they are not subject to rot caused by the inevitable presence of moisture and never need painting. Although such gutters have great advantages over wood gutters, they must, like wood gutters, still be attached to the wood fascia of a building. Unlike wood gutters, the side walls of these gutters, particularly in the case of plastic gutters, cannot have nails driven through them; therefore, gutter hangers are the most practical devices for attaching plastic gutters to a building. There are, however, disadvantages with the various gutter hangers in the prior art, such as requiring the use of several nails to attach one gutter hanger or the necessity of using a two-step intallation procedure of first attaching the gutter hanger to the fascia and then placing the gutter into the gutter hanger, both of which are quite time consuming.

When attached to the fascia, aligning a gutter that has been mounted within a gutter hanger with adjacent gutters is another problem encountered in the prior art.

A further disadvantage in the prior art is the lack of free horizontal movement in the gutter, both for facilitating installation as well as allowing it to expand in summer heat or to contract in winter cold, after it has been fitted in a gutter hanger.

Accordingly, it is a major object of the present invention to provide a novel gutter hanger which is not time consuming to install.

It is another object of the present invention to provide a novel gutter hanger which simplifies gutter installation.

It is a further object of the present invention to provide a novel gutter hanger which allows rotational adjustment of the gutter hanger for aligning the gutter.

It is a still further object of the present invention to provide a novel gutter hanger which allows the gutter to have free horizontal movement.

In order to accomplish these objectives, the present invention provides, for supporting a horizontal, generally U-shaped gutter having a front wall with an inwardly and downwardly turned flange that provides an open bottom recess extending continuously along its horizontal upper edge, a generally straight vertical rear wall and a bottom wall having a downwardly projecting, horizontal flange extending continuously therealong adjacent the rear wall, a gutter hanger for attaching the gutter to the wood fascia of a building.

The gutter hanger of the invention comprises a rigid, one piece, generally L-shaped bracket of sheet material of greater horizontal width than thickness having integrally connected, mutually perpendicular, upper forwardly extending and rear downwardly extending legs.

The upper forwardly extending bracket leg is adapted to extend in a horizontal plane across the top of the gutter and has on its forward end a downwardly, forwardly and upwardly turned flange. The upwardly turned, horizontal, free end of the flange is adapted to be positioned within the open bottom recess on the upper edge of the gutter front wall to support the upper edge of the gutter from beneath.

The rear downwardly extending bracket leg is adapted to be located between the fascia and the rear wall of the gutter parallel thereto and has its lower end extending downwardly beyond the rear wall. The downwardly extending bracket leg has on its lower end forwardly and upwardly turned horizontal flanges adapted to be positioned beneath and in front of the downwardly projecting bottom wall flange of the gutter. As so mounted, the upwardly turned flanges support the gutter from beneath and maintain the rear wall parallel with the fascia.

The upper forwardly extending bracket leg has an upwardly extending, integral support ferrule means which defines a single, open-bottomed, extended, nail receiving opening means. The nail receiving opening means is positioned on an axis extending from a location adjacent the upwardly turned, horizontal free end of the upper bracket leg to a location adjacent the rear downwardly extending bracket leg to slideably receive a single nail above portions of the upper forwardly extending bracket leg and above the gutter for free driving of the nail into the fascia to support the gutter hanger. The ferrule means allows rotational adjustment of the gutter hanger around the nail for aligning the gutter supported thereon.

In the preferred embodiment, the support ferrule means comprises a pair of support ferrules spaced from one another along a generally horizontal axis with a portion of the upper bracket leg extending therebetween. Furthermore, the rear downwardly extending leg includes two vertical downwardly extending prongs on its lower end. The vertical slot created between the two prongs is adapted to receive a second nail which prevents rotation of the gutter hanger after the gutter had been properly aligned.

Other objects, features, and advantages of the present invention will appear from the following detailed description of a preferred embodiment thereof, taken together with the accompanying drawings, wherein.

Figure 1:
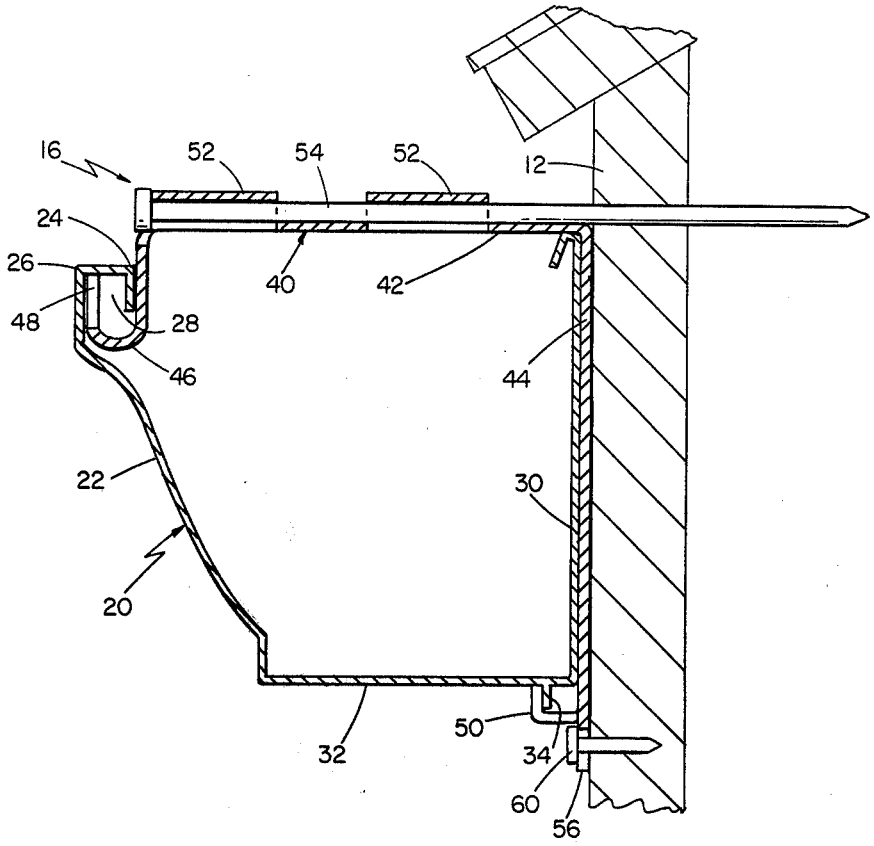
FIG. 1 is a cross-sectional view of the gutter hanger supporting a gutter and attached to a building fascia.
Figure 3:
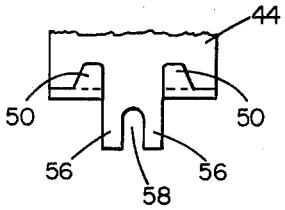
FIG. 3 is an enlarged front view of the lower end of the rear downwardly extending bracket leg of the gutter hanger.
Figure 2:
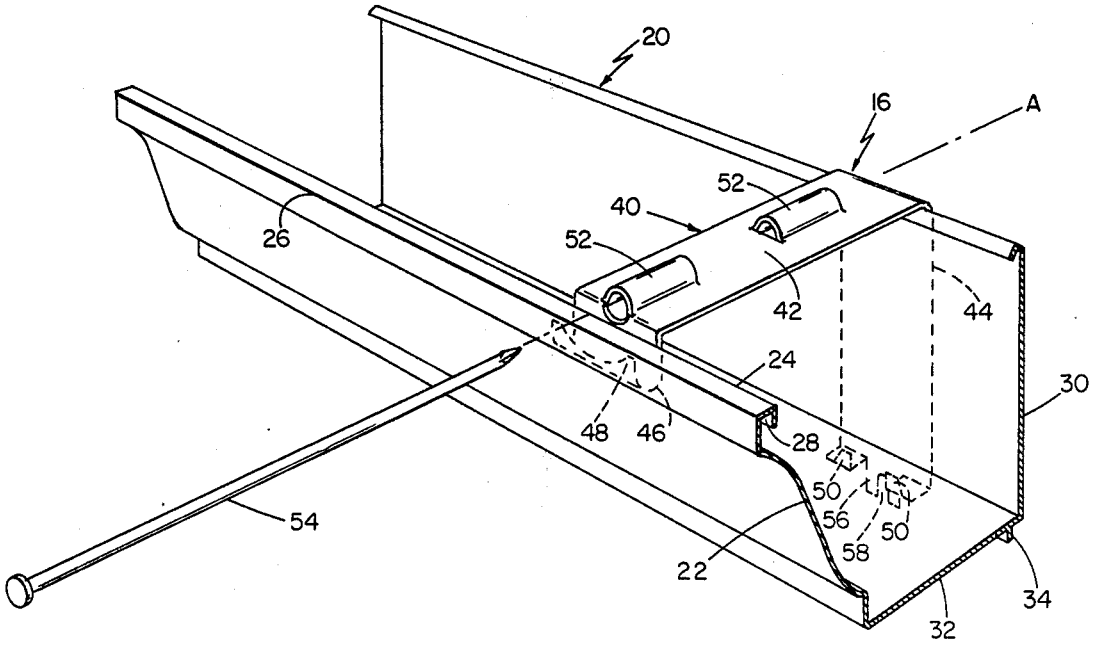
FIG. 2 is a perspective view of the gutter hanger of FIG. 1 supporting a gutter.

Referring to the drawings, the gutter hanger of the present invention, generally designated 16, is shown attached to a wood fascia 12 of a building by a two nails 54 and 60 for supporting a horizontal, generally U-shaped gutter, generally designated 20, of metal or plastic.

More specifically, the horizontal, generally U-shaped gutter 20 has a front wall 22, a generally straight vertical rear wall 30 and a bottom wall 32. Extending continuously along the horizontal upper edge 26 of front wall 22 is an inwardly and downwardly turned flange 24 that provides an open bottom recess 28 having a generally rectangular shape. Bottom wall 32 has a downwardly projecting, horizontal flange 34 extending continuously along and adjacent rear wall 30.

The novel gutter hanger 16 of the present invention comprises a rigid, one piece, generally L-shaped bracket 40 manufactured from a sheet material of either metal or plastic of greater horizontal width than thickness.

More specifically, bracket 40 has integrally connected, mutually perpendicular, upper forwardly extending and rear downwardly extending legs 42 and 44, respectively. The upper forwardly extending bracket leg 42 is adapted to extend in a horizontal plane across the top of gutter 20 and has on its forward end a downwardly, forwardly and upwardly turned flange 46. The upwardly turned, horizontal, free end 48 of flange 46 is adapted to be positioned within the open bottom recess 28 on the upper edge 26 of gutter front wall 22 to support the upper edge 26 of gutter 20 from beneath.

The rear downwardly extending bracket leg 44 is adapted to be located between and parallel to both fascia 12 and the rear wall 30 of gutter 20 with its lower end extending downwardly beyond the rear wall 30. The downwardly extending bracket leg 44 has on its lower end forwardly and upwardly turned horizontal flanges 50 which are adapted to be positioned beneath and in front of the downwardly projecting bottom wall flange 34 of gutter 20 to support gutter 20 from beneath.

The upper forwardly extending bracket leg 42 has a pair of upwardly extending support ferrules 52, positioned on a horizontal axis A and extending from a location adjacent the free end 48 of bracket leg 42 to a location adjacent the rear downwardly extending bracket leg 44, for receiving nail 54.

In the preferred embodiment, rear downwardly extending bracket leg 44 further includes two vertical downwardly extending prongs 56 on its lower end which provide therebetween a vertical slot 58 for receiving a second nail 60.

Gutter hanger 16 may be mounted on gutter 20 before attaching it to fascia 12. To do so, the upwardly turned, horizontal, free end 48 of upper bracket leg 42 is positioned within the open bottom recess 28 of gutter front wall 22 and the forwardly and upwardly turned horizontal flanges 50 of rear downwardly extending bracket leg 44 are positioned beneath and in front of the downwardly projecting bottom wall flange 34 so that gutter 20 and gutter hanger 16 may be slid horizontally relative to one another.

Gutter hanger 16, with gutter 20 mounted thereon, may then be positioned at the desired height on fascia 12 and attached to fascia 12 by nail 54. Thus attached, the nail receiving support ferrules 52 allow rotational adjustment of gutter hanger 16 around nail 54 for aligning the gutter 20 supported thereon with any adjacent, similarly supported gutters. A second nail 60 is then placed in the vertical slot 58 at the lower end of the rear downwardly extending bracket leg 44 to prevent rotation of gutter hanger 16 supporting the properly aligned gutter 20 therein. As so mounted, gutter hanger 16 is effective in maintaining gutter 20 in a horizontal position parallel to fascia 12 when attached thereto. Gutter hanger 16 also allows gutter 20 to move horizontally in a direction parallel to fascia 12 to accommodate its contraction and expansion.

What is claimed is:

1. A gutter hanger for attachment to the wood fascia of a building for supporting a horizontal, generally U-shaped gutter having a front wall with an inwardly and downwardly turned flange providing an open bottom recess extending continuously along its horizontal upper edge, a horizontally extending, generally straight vertical rear wall and a bottom wall having a downwardly projecting, horizontal flange extending continuously therealong adjacent said rear wall said gutter hanger comprising a rigid, one piece, generally L-shaped bracket of sheet material of greater horizontal width than thickness having integrally connected, mutually perpendicular, upper forwardly extending and rear downwardly extending legs said upper forwardly extending bracket leg being adapted to extend in a horizontal plane across the top of said gutter and having on its forward end a downwardly, forwardly and upwardly turned flange having an upwardly turned, horizontal, free end adapted to be positioned within the open bottom recess on the horizontal upper edge of the front wall of said gutter to support said upper edge of said gutter from beneath, and said rear downwardly extending bracket leg being adapted to be located between said fascia and the rear wall of said gutter parallel thereto with the lower end of said downwardly extending leg extending downwardly beyond said rear wall of said gutter, said downwardly extending bracket leg having on its lower end forwardly and upwardly turned horizontal flange means adapted to be positioned beneath and in front of said downwardly projecting bottom wall flange to support said gutter from beneath with its rear wall parallel to said fascia said bracket legs cooperating to support said gutter for horizontal adjustment relatively thereto in a direction parallel to said fascia said upper forwardly extending bracket leg having integral support ferrule means extending upwardly therefrom defining a single open-bottomed extended nail receiving opening means having an axis extending therealong from a location adjacent its free end to a location adjacent said rear downwardly extending bracket leg for slideable receiving a single nail above portions of said upper forwardly extending bracket leg and above said gutter for free driving of said nail into said fascia to support said gutter hanger thereon, while allowing rotational adjustment of said gutter hanger around said nail for alignment of said gutter hanger with the gutter supported thereby.

2. A gutter hanger as claimed in claim 1, wherein said support ferrule means comprises a pair of support ferrules spaced from one another along said axis with a portion of said upper bracket leg extending therebetween.

3. A gutter hanger as claimed in claim 2, wherein said rear downwardly extending bracket leg further includes two vertical downwardly extending prongs on its lower end providing therebetween a vertical slot adapted to receive a second nail, thereby preventing rotation of said gutter hanger supporting said aligned gutter therein.

* * * * *